US006554295B2

(12) United States Patent
Rittmeyer

(10) Patent No.: US 6,554,295 B2
(45) Date of Patent: Apr. 29, 2003

(54) STRAPLESS TOELOCK BINDING FOR SNOWBOARDS

(75) Inventor: Geoffrey E. Rittmeyer, Vashon, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/969,332

(22) Filed: Oct. 1, 2001

(65) Prior Publication Data

US 2002/0008366 A1 Jan. 24, 2002

Related U.S. Application Data

(62) Division of application No. 09/541,422, filed on Apr. 3, 2000.

(51) Int. Cl.[7] ..... A63C 1/02; A63C 9/10; A63C 9/00; B62B 9/04

(52) U.S. Cl. ..... 280/11.3; 280/14.22; 280/633; 280/620; 280/624

(58) Field of Search ..... 280/14.22, 11.3, 280/620, 624, 633; 36/50.5, 117.1

(56) References Cited

U.S. PATENT DOCUMENTS

| | | | | | |
|---|---|---|---|---|---|
| 2,130,693 | A | * | 9/1938 | Nashe et al. | 280/619 |
| 2,145,102 | A | * | 1/1939 | Spini | 36/117.3 |
| 2,929,636 | A | * | 3/1960 | Jones et al. | 280/11.3 |
| 3,009,710 | A | * | 11/1961 | Marker | 280/620 |
| 3,100,119 | A | * | 8/1963 | Marker | 280/620 |
| 3,160,421 | A | * | 12/1964 | Bugg | 280/620 |
| 3,854,743 | A | | 12/1974 | Hansen | |
| 4,050,716 | A | * | 9/1977 | Kubelka et al. | 280/614 |
| 4,679,815 | A | * | 7/1987 | Pascal et al. | 280/618 |
| 4,979,760 | A | | 12/1990 | Derrah | |
| 5,172,924 | A | * | 12/1992 | Barci | 280/14.22 |
| 5,503,414 | A | | 4/1996 | Teeter et al. | |
| 5,505,477 | A | | 4/1996 | Turner et al. | |
| 5,575,496 | A | | 11/1996 | Luitz et al. | |
| 5,595,396 | A | | 1/1997 | Bourdeau | |
| 5,660,410 | A | | 8/1997 | Alden | |
| 5,713,587 | A | * | 2/1998 | Morrow et al. | 280/14.21 |
| 5,806,876 | A | | 9/1998 | Alden | |
| 5,816,603 | A | | 10/1998 | Borsoi | |
| 5,853,188 | A | | 12/1998 | Alden | |
| 6,061,870 | A | * | 5/2000 | Dodge et al. | 16/2.1 |
| 6,231,057 | B1 | * | 5/2001 | Reuss et al. | 280/14.21 |
| 6,347,805 | B1 | * | 2/2002 | Maravetz et al. | 280/14.22 |

FOREIGN PATENT DOCUMENTS

| | | | | |
|---|---|---|---|---|
| CH | 667 213 A5 | | 9/1988 | |
| DE | 23 59 309 | | 6/1975 | |
| EP | 0 255 910 A2 | | 2/1987 | |
| EP | 0 351 881 A2 | | 1/1990 | |
| FR | 2604913 A1 | * | 4/1988 | A63C/5/00 |
| FR | 2 627 993 A1 | | 9/1989 | |
| FR | 2 732 230 A1 | | 10/1996 | |
| WO | WO 98/47578 A1 | | 10/1998 | |

* cited by examiner

*Primary Examiner*—Paul N. Dickson
*Assistant Examiner*—Joselynn Y Sliteris
(74) *Attorney, Agent, or Firm*—Christensen O'Connor Johnson Kindness PLLC

(57) ABSTRACT

A binding system for securing a boot (10) having an instep portion and a toe portion to a snowboard (28) includes an attachment member (12) provided on the toe portion of the sole of the boot, a corresponding engaging member (16) on a frame (14), and a strap (18) for securing a portion of the boot in the frame. One end (58) of the instep strap is anchored to one side of the base, while a loose end of the strap is passed over the instep boot portion and tightened by means of a ratcheting buckle mechanism (48) to the opposing side of the frame once the user has placed his foot on the frame. Thus, the toe is readily and firmly secured to the frame, and the strap is merely tightened.

5 Claims, 6 Drawing Sheets

STRAPLESS TOELOCK BINDING FOR SNOWBOARDS

CROSS-REFERENCE TO RELATED APPLICATION

This application is a divisional of prior application Ser. No. 09/541,422, filed Apr. 3, 2000, priority from the filing date of which is hereby claimed under 35 U.S.C. §120.

FIELD OF THE INVENTION

The present invention relates generally to boot bindings for glide boards for snow and more particularly to a strapless toe lock binding for snowboards.

BACKGROUND OF THE INVENTION

Conventional snowboards utilize one of two available binding types. A binding system having two straps, one for securing the toe and another at the instep of the boot, is preferred by some users of snowboards who engage in freestyle type snowboarding. One end of each strap is attached to the snowboard binding on either the lateral or medial side of the boot, and the other end passes over the user's boot and is attached to the snowboard via a fastening mechanism on the other side. An alternative to the two strap binding system available to snowboard users is a step-in binding system. This type of system includes cleats, bales or latches on the boot that engages with catches or jaws on the binding to hold the boot of the user firmly to the snowboard. Step-in binding systems may utilize one central cleat under the boot toe, and a rear cleat under the boot heel portion. One jaw is spring-loaded to lock down the boot, and is releasable by movement of a lever. Alternately, two bales are provided along the lateral and medial sides of the boot.

One consideration in the design of snowboard bindings is the degree of maneuverability and responsiveness that the body position of the user has on the snowboard. A snowboard user's feet may be positioned perpendicular to the longitudinal axis of the snowboard. A boarder leans forward and rearward to control the long edge of the snowboard as it digs into the snow for curving and speed control, and leans side to side for turning and maneuvers. A conventional two-strap binding system provides comfort and flexibility to the user, and a high degree of maneuverability. However, lift of the boot away from the board at the toe and heel when trying to carve out tight turns limits the degree of control. Clamping down tighter on the straps to make the snowboard more responsive can lead to discomfort.

Step-in binding systems represent an advancement over two-strap systems because the toe and heel portions of the boot are attached directly to the snowboard surface. With a step-in system, the user can achieve the responsiveness that the two-strap binding systems lacked. However, what the step-in system achieves in control, it lacks in flexibility and comfort. This was due to the fact that step-in boots are typically rigid or rigidly enforced to transfer the user's body movement to the snowboard. Freestyle snowboarders often prefer the flexibility of strap-bindings which allow more freedom of movement while sacrificing responsiveness, while recreational users sometimes favor the more responsive step-in bindings.

Another concern to many snowboard users is the ease of getting into and out of the snowboard. With a strap-in system, a user has to undo two straps. This proves cumbersome, particularly when standing in lift lines and loading on and off lifts. Advancements made in buckles and fastening devices have made the task of getting into and out of a two-strap system quicker, but step-in systems still lead the way with only a single movement required to release the boot. This is because, although a step-in binding system may have two or three points of attachment, only one is necessary to lock the boot in place with a spring-loaded mechanism.

SUMMARY OF THE INVENTION

The present invention provides a binding system for securing a boot to a snowboard. The boot includes an upper having an instep portion and a toe portion. The binding system includes a frame to attach to the snowboard. The boot includes a sole defining at least one attachment member to attach to a corresponding attachment member on the frame. The binding system also includes an adjustable binding strap to hold the boot to the frame and securable on either side to the frame.

In the preferred embodiment, an attachment member provided on a toe portion of the sole of the boot engages with a corresponding engaging member on the frame. The frame includes a substantially flat base that is secured to the snowboard. One end of the instep strap is anchored to one side of the base, while a loose end of the strap is passed over the instep boot portion and tightened by means of a ratcheting buckle mechanism to the opposing side of the frame once the user has placed his boot on the frame. Thus, the toe is readily and firmly secured to the frame, and the strap is merely tightened, providing a three-point attachment system.

Benefits derived from the present invention include the provision of a boot binding system that is quick and easy to get into and out of and which has the control, maneuverability and response of a step-in binding with the flexibility and comfort suited for freestyle snowboarding.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENTS

Figure 1:
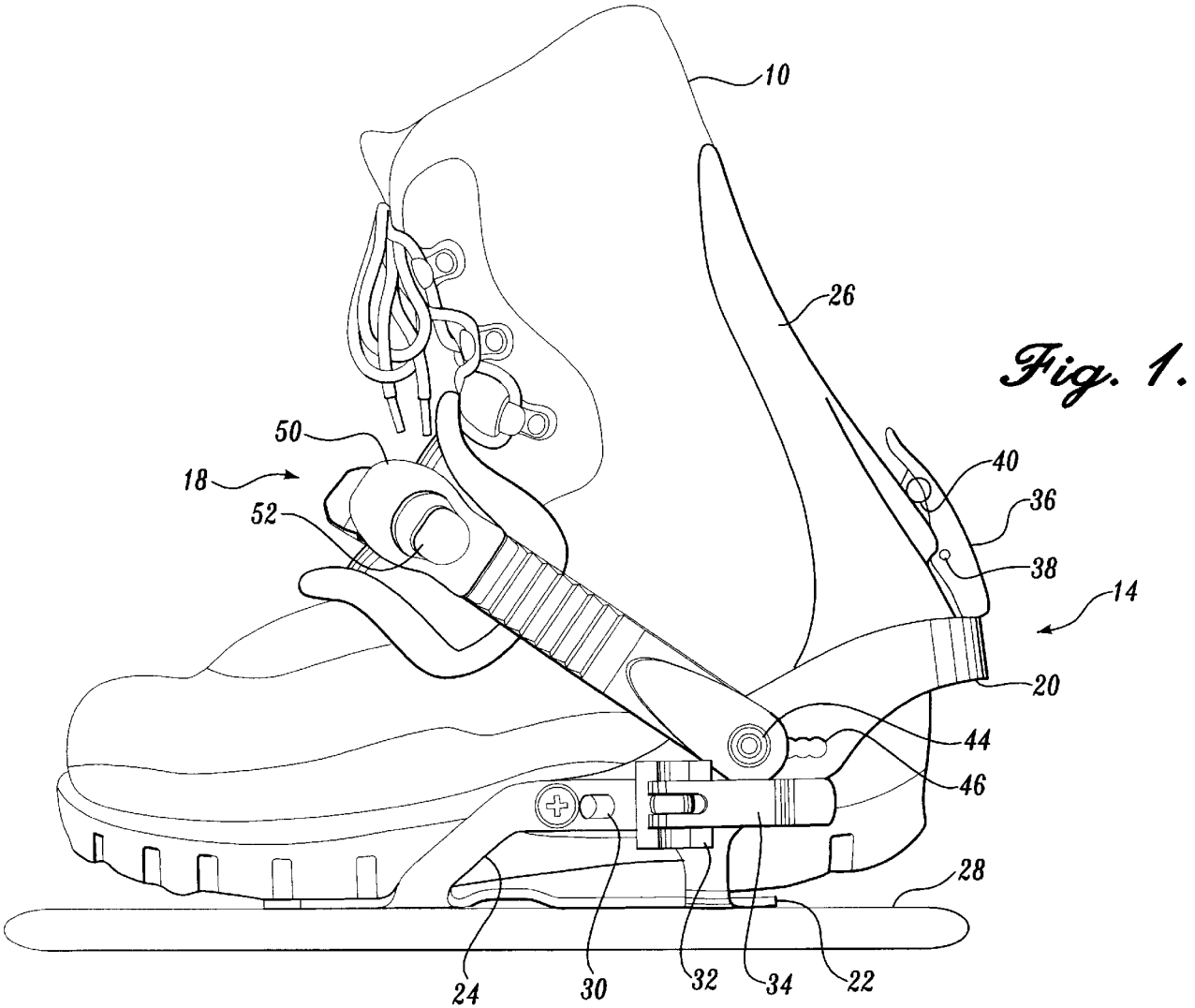
FIG. 1 is a side elevation view of one embodiment of the boot mounted on the snowboard, using the binding system of the present invention.

A first embodiment of a binding system constructed in accordance with the present invention is shown in FIGS.

1–4. The binding system includes a boot 10 to which is secured a first attachment member 12, preferably disposed beneath a forefoot portion of the sole of the boot 10. The binding system further includes a frame 14 secured to the snowboard. A second attachment member 16 is secured to the frame 14 and selectively engages the first attachment member 12. The binding system further includes a binding strap 18 that passes from the medial to the lateral sides of the frame 14, passing over the instep of the boot 10. Finally, the frame 14 is provided with a heel riser 20 that extends upwardly from the frame 14 beyond the heel of the boot 10. This structure serves to securely and readily bind the boot 10 to the frame 14. Engagement of the first attachment member 12 with the second attachment member 16 vertically secures the toe end of the boot 10, and also secures the boot 10 from moving forwardly relative to the frame 14. The heel riser 20 operates with the fastening members, serving to prevent the boot 10 from moving rearwardly relative to the frame 14. Finally, the strap 18 draws the instep and heel end of the boot 10 downwardly toward the frame 14, securing the heel end of the boot 10 from vertical movement. Before describing the operation of this preferred embodiment of a binding system, each of the components will first be described.

Referring to FIG. 1, boot 10 is shown in an engaged position on a frame 14. The frame 14 in turn includes a baseplate 22, side extensions 24, heel riser 20 and a high back 26. Frame 14 is secured to a snowboard 28 (shown edgewise) by screws in a conventional manner. The frame 14 has a longitudinal axis aligned with the longitudinal axis of the boot 10, and positionable generally perpendicular to a longitudinal axis of the snowboard 28. The side extensions 24 rise upwardly from lateral and medial sides of the baseplate member 22. Side extensions 24 include guide slots 30 that receive pins on the forward ends of U-shaped heel riser 20 to allow forward or backward adjustment in the direction of the longitudinal axis of the frame 14. The heel riser 20, configured as a loop, can thus be adjusted to fit boots of varying sizes. The heel riser 20 is fixed in position relative to the baseplate 22 by clamps 32 having quick release levers 34.

The heel riser 20 acts as a rearward restraining stop to the high back 26. High back 26 is mounted on the heel riser 20 and is contoured to surround the Achilles tendon area of the boot 10. The high back 26 is mounted to pivot forward or rearward in the direction of the longitudinal axis of the frame. Rearward rotation is halted by a clamp 36, mounted on a rear side of the high back 26, abutting against the rear portion of the heel riser 20. In this configuration (illustrated in FIG. 1), the ankle portion of the boot is flexed to maintain a minimum forward lean position. The clamp 36 can be pulled toward the rear to pivot the clamp 36 about linkage pins 38 and 40, causing the clamp 36 to disengage the rear portion of the heel riser 20. This allows the high back 26 to pivot further towards the rear for walking comfort.

Figure 2:
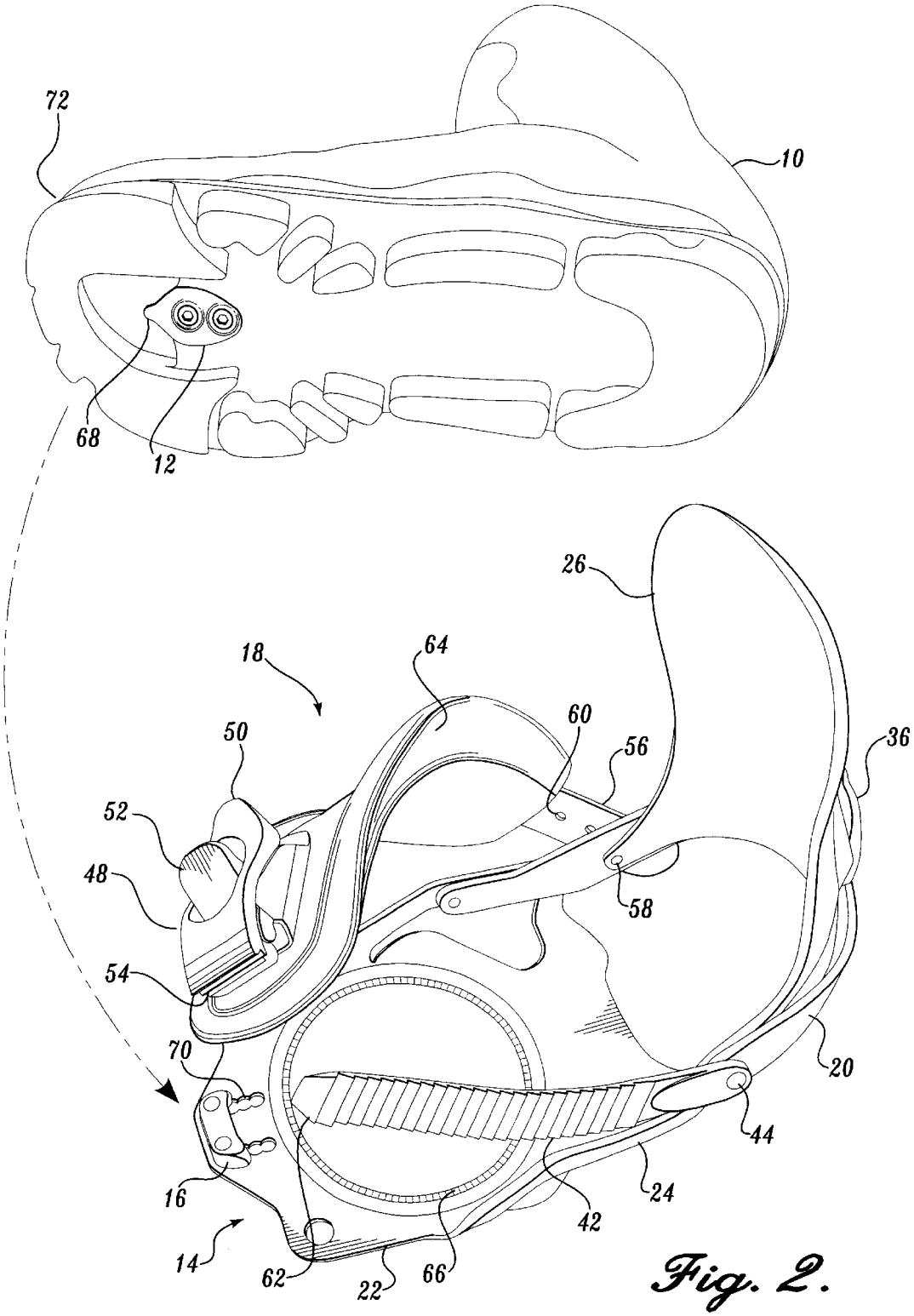
FIG. 2 is an exploded pictorial view of the binding system of FIG. 1.

Referring to FIGS. 1 and 2, the binding strap 18 is secured to a lateral side of heel riser 20 and mates to an elongate serrated piece 42 attached to the opposite, medial side of heel riser 20. The second piece is mounted to the medial side extension 24 by an adjustable connecting pin 44. Pin 44 is received within a detented slot 46 formed longitudinally in the side extension 24, allowing selective longitudinal adjustment of the pin 44 position. Selective positioning of pin 44 (by a threaded nut, not shown) repositions the serrated piece 42 to move backward or forward relative to the frame 14 over the user's instep. Adjustment of riser 20 provides for boots of varying sizes, while adjustments of pin 44 provides for varying instep sizes or binding strap location on the instep portion of the boot 10.

The binding strap 18 is provided with a conventional buckle 48 that selectively engages the free end of the serrated piece 42. The buckle 48 includes a ratchet-type lever member 50 and a pawl member 52. The lever 50 has an edge 54 to engage the serrations on the serrated binding strap piece 42. As the lever 50 is cranked through its arc of motion, the pawl member 52 secures the serrated piece 42 to tighten the strap 18. Disengagement of pawl member 52 releases the binding strap pieces relative to one another.

As is readily apparent in FIG. 2, a preferred binding strap 18 suitable for use in the present invention has several constituent components. The binding strap 18 includes a structural elongate binding piece 56 attached to the lateral side of heel riser 20 of the frame 14. The binding piece 56 is longer than the serrated piece 42, and likewise pivotably secured to the corresponding side extension 24 by a pivot pin 58. The binding strap piece 56 is adjustably translatable in the longitudinal direction, in the same fashion as the opposing serrated piece 42 to position the binding strap 18 higher or lower on the instep portion of the boot 10. The longer binding strap piece 56 is provided with a series of adjustment holes 60 to enable shortening or lengthening of the effective length of the binding strap piece 56. The pivot pin 58 is passed through the selected hole 60 for a desired length. The buckle 48 is secured to the free end of the binding piece 56, and selectively receives the loose end 62 of the serrated binding piece 42. A pad 64 is suitably mounted on the interim surface of the binding piece 56, for comfort and close fit to the instep.

Referring to FIG. 2, the frame 14 is conventionally secured to the snowboard 28. The baseplate member 22 of the frame has a circular aperture formed to define indentations 66. A circular retaining plate (not shown) is received within the aperture and engages the indentations 66. The baseplate member 22 is rotated to a desired orientation relative to the snowboard 28, and the retaining plate is screwed down to the snowboard 28 to secure the frame 14 in position.

Referring again to FIG. 2, the illustrated preferred embodiment of a first attachment member 12 is a flat plate having as its tip a forward projection 68, configured to engage the corresponding second attachment member 16 on the binding frame 14. The first attachment member 12 is mounted, such as by a pair of screws, on the longitudinal axis of the boot, generally under the ball of the foot in a forefoot portion of the sole. The forward projection 68 extends forwardly into a shallow recess formed in the sole, for the purpose of accommodating the second attachment member.

Figure 3:
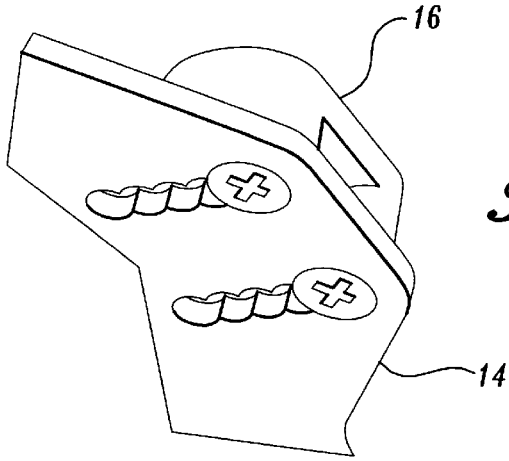
FIG. 3 is a partial perspective view of the embodiment of FIG. 1 showing adjustability in the forward or rear direction along the longitudinal axis of the frame.

The second attachment member 16 has an inverted U-shaped appearance. The sides of the second attachment member 16 are secured to the frame, while the center portion creates an aperture, defined between the center portion and the baseplate member 22. In the preferred embodiment, the second attachment member 16 is centrally mounted on the longitudinal axis of the frame 14, toward a forward end thereof. The second attachment member 16 is forwardly or rearwardly adjustable along the longitudinal axis of the frame 14. For this purpose, the baseplate 22 is provided with detented mounting slots 70, to fit the varying boot sizes available on the market (FIG. 3). Screws pass from the underside of the baseplate member 14, through the slots 70, into the sides of the second attachment member 16. Other known adjustable mountings, such as spring loaded pins, can be used.

The use of the binding system of the present invention will now be described with reference to the illustrated preferred embodiment. To bind the boot, the snowboard user first places the boot 10 over the frame 14 with the first attachment member 12 and projection 68 at approximately a 45-degree angle relative to the plane of the frame 14. The user then steps down, so as to engage the forward projection 68 on the first attachment member 12 under the center portion of the second attachment member 16, into the rear aperture created by the second attachment member 16. When the second attachment member 16 captures the first attachment member 12, the user's heel is guided down into the frame 14 with the aid of the highback 26 and heel riser 20. The highback 26 is contoured to substantially resemble the contours of the rear portion of the boot 10. When so positioned, the second attachment member 16, by acting on the first attachment member 12, restrains forward movement of the boot 10. The heel riser 20 restrains rearward movement of the boot 10. The second attachment member 16 also holds the forefoot portion of the boot 10 downwardly against the frame 14.

At any time during the stepping-in routine, the snowboard user may make adjustments to the frame 14 by disengaging the quick release levers 34 on both lateral and medial side extensions 24 of the frame 14 to allow forward or rear movement of the heel riser 20 to the desired level of comfort or fit. If the user is satisfied with the location of the heel riser 20, but the user feels the boot to frame fit is not correct, the user may also adjust the location of the second attachment member 16.

Following engagement of the first attachment member 12 into the second attachment member 16 and placement of the heel into the frame 14, the binding strap 18 is ready to be secured.

To engage the two binding strap pieces, the snowboard user places the long binding strap piece 56 across and over the instep portion of the boot 10. The loose end 62 of the short serrated binding strap piece 42 is guided through an opening in the buckle 48, located just below the lever edge 54. The lever pivot point is substantially towards the lever edge 54 and away from the lever handle 50 to multiply the force applied to the serrated teeth 42 of the short binding strap piece. The lever 50 is actuated by the user through the range of motion. As the lever 50 is pulled up and out, the lever edge 54 locks with the serrated teeth 42 on the short binding piece. As the short binding strap piece 42 advances, the pawl 52 catches on the serrated teeth 42 to prevent the short binding strap piece 42 from retracting. The pawl 52 is spring loaded to keep it in place. The binding strap 18 is tightened across the instep using the buckle 48 until the heel portion of the boot 10 is firmly bound to the binding frame 14. Thus securing the boot 10 merely takes stepping into the frame 14, thereby engaging the toe, and securing the strap 18. A simple, secure binding for good force transmission is achieved. To release the binding, the buckle 66 is undone and the user steps out of the frame 14.

At any time during the normal use, the snowboard user may adjust the length of one or both of the binding strap pieces. For example, the user may find that the pad 64 is not in the correct position, the user may then adjust the length of the long binding strap piece 56 by using a different adjustment hole 60. The user may also notice that the pad is resting too low or too high on the instep portion of the boot. The user may pivot the pad 64 along with the binding strap 18 about the binding strap pivot points 44 and 58. Rotating the binding strap about the pivot points may upset the angle at which the pad 64 rests on the instep portion of the boot; therefore necessitating forward or rear adjustment of the pivot points 44 and 58 along the guide slots 42.

While the preferred embodiment has been described in terms of first and second attachment members 12 and 16, alternate attachment members could be utilized. For example, boot attachment member mounted forwardly of the boot toe, or two boot attachment members provided on either side of the toe ends to the boot could be employed. Rather than having an engaging projection 68 extending forwardly from attachment member 12, a rearwardly extending projection could be used. In such a configuration, the forward attachment member could secure the boot 10 from moving forwardly relative to the binding 14, and the heel riser 20 would not be required.

Alternative configurations of rearward straps could be one with attachment members 12, 16, in place of the heel riser 20. For example, a projection extending upwardly from the frame 14 behind the heel of boot 10, or a projection on the boot heel extending into an aperture in the frame, or vice versa, could be employed.

Other alternative configurations of binding straps include a binding strap configured to engage boot 10 at the boot toe portion. Such configurations may further replace rearward binding strap 18 with attachment members 12 and 16 at the heel portion of the boot 10. In these configurations, attachment member 12 may be placed on boot heel portion or on the frame 14, with corresponding attachment member 16 on frame or boot, respectively. Still other alternative configurations may have more than one attachment member 12 to engage with corresponding members 16, and in combination with a binding strap at the boot toe portion.

The highback support 26 could be eliminated if desired, particularly for boots 10 including an internal or external highback support as part of the boot.

Numerous versions of the preferred embodiment illustrated are thus possible, all having an attachment member and straps for securing the boot. Several such alternative embodiments are now desirable for purposes of illustration, without limitation.

Figure 5:
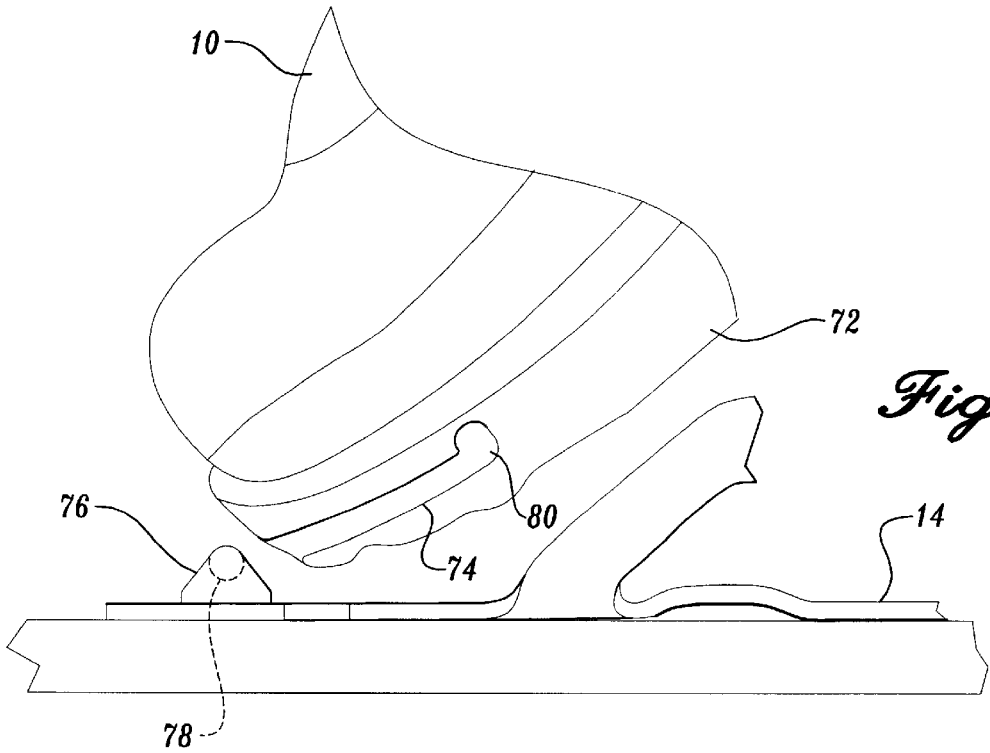
FIG. 5 is a side elevation view of an alternate embodiment of the boot to frame attachment mechanism of the present invention using a side pin on the frame and a corresponding groove on the boot sole.

In a first alternate embodiment, the boot to frame attachment members have a pin and groove arrangement. Referring to FIG. 5 for greater detail of this embodiment, the toe portion 72 of the boot sole is provided with side grooves 74 positioned on either side of the boot sole toe portion 72. The grooves 74 along the medial and lateral sides of the boot sole toe portion 72 take the place of the first attachment member 12. The corresponding second attachment member 76 positioned on the frame 14 is provided in the form of a base member 76 having lateral and medial inwardly extending elevated pin 78 , to engage the boot sole toe portion groove 74. Although FIG. 5 only shows one side view, it should be readily apparent that the opposing side is similarly configured. During normal use, the pin 78 seats into the groove rear wall 80 to prevent the boot 10 from traveling further in the forward direction. In other respects, the embodiment of FIG. 5 is constructed the same as that of FIG. 1 and thus includes the binding strap 18.

Figure 6:
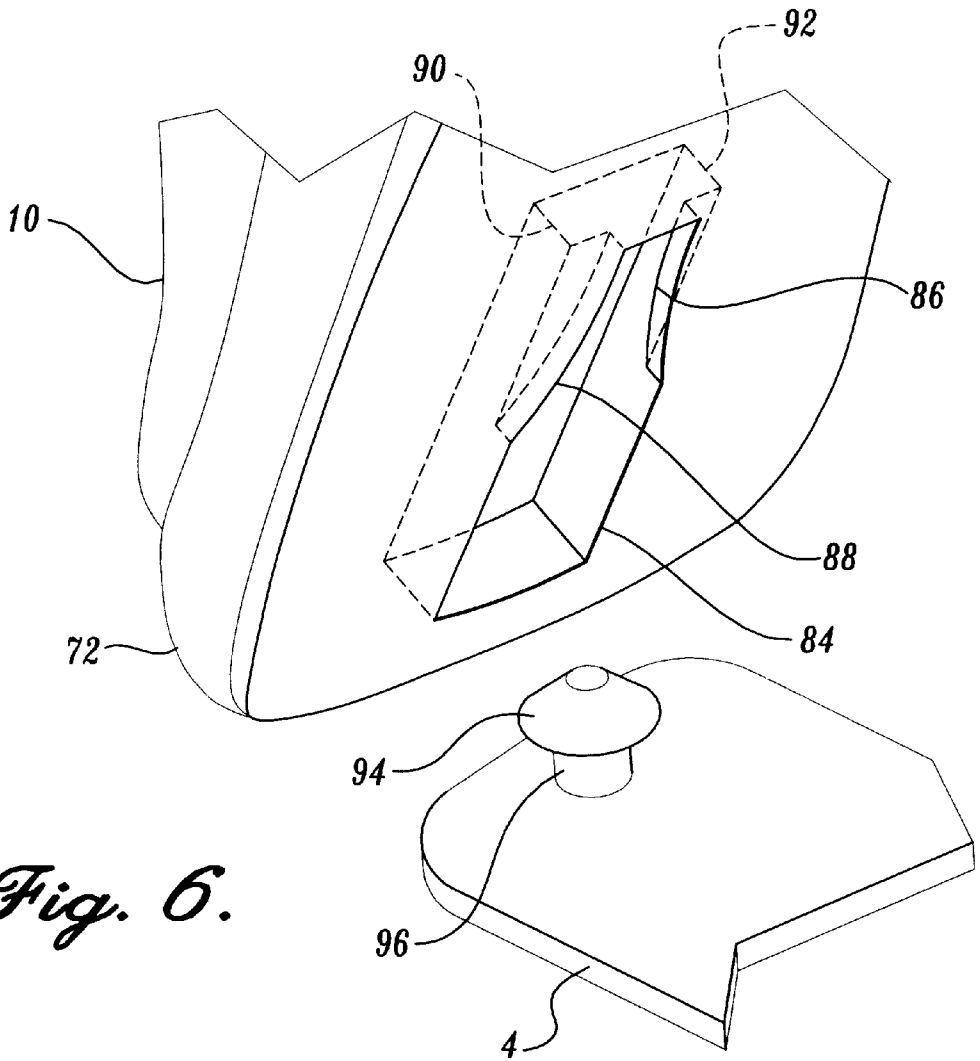
FIG. 6 is a perspective view of a further alternate embodiment of the boot to frame attachment mechanism of the present invention using a T-shaped pin and a boot cavity for engagement therein

Referring now to FIG. 6, in a second alternate embodiment, the first attachment member is configured as a cavity 84 defined in the lower surface of the boot sole toe portion 72, on the longitudinal axis of the boot beneath the ball of the foot. The cavity 84 has tapered portions 86 and 88 beginning about midway along the length of the cavity 84, and tapering in the direction towards the heel portion of the boot 10. The cavity 84 has recessed portions 90 and 92 cut a predetermined depth above the lower surface of the tapered cavity edges 86 and 88. The recessed portions 90 and 92 create shelves on the inside of the cavity edges 86 and 88.

The cavity 84 receives the bulbous head of a T-shaped pin 94 that projects upwardly from the frame 14, serving as the second attachment member. The base 96 of the pin 94 is fastened to the forward edge of the frame 14. When the T-shaped head of the pin 94 is received within the slot-like cavity 84, the pin 94 prevents the user's boot from further forward travel while also vertically securing the toe of the boot 10. The embodiment of FIG. 6 also includes a binding strap 18 as in FIG. 1.

Figure 4:
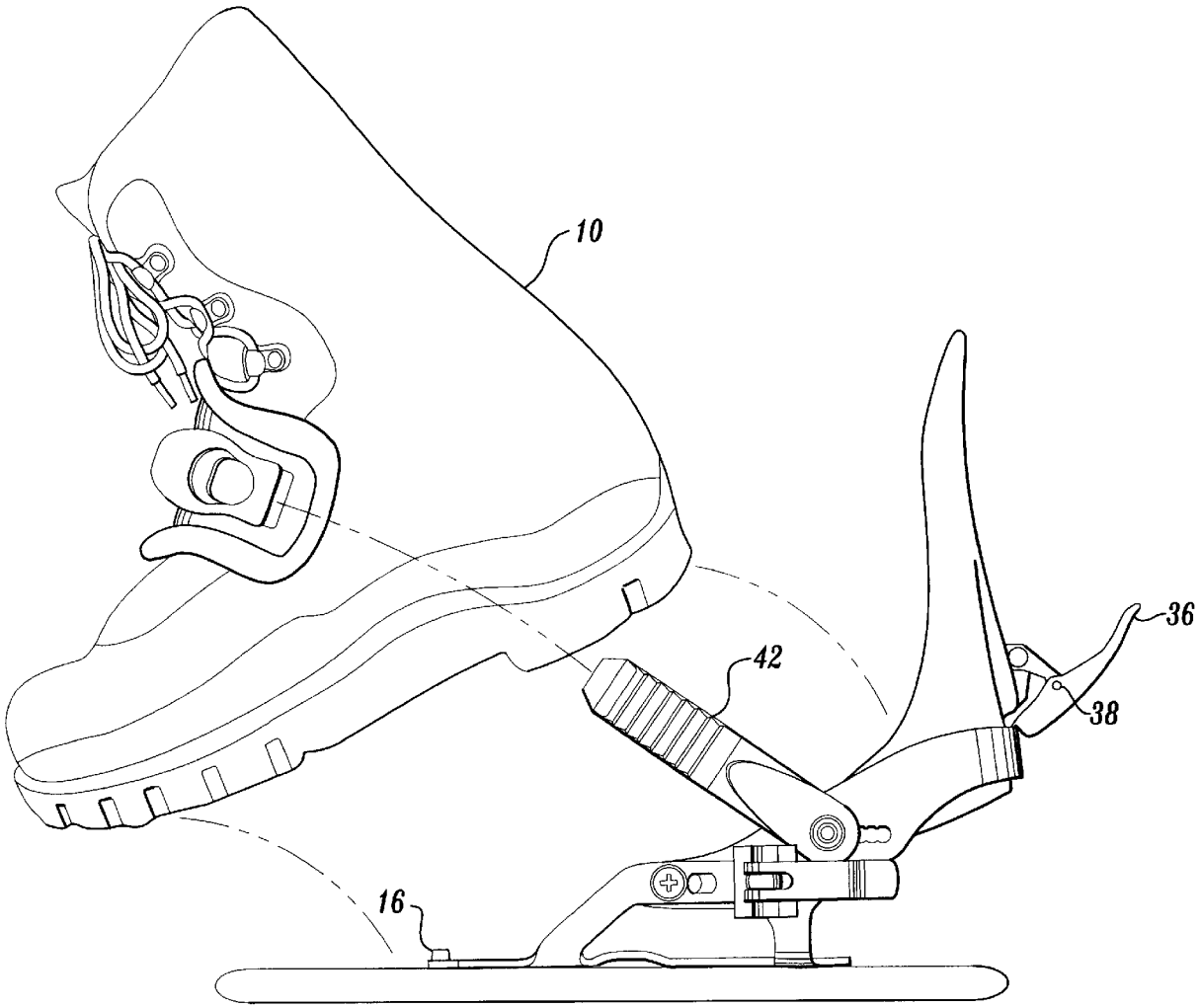
FIG. 4 is a side plan view of one embodiment of the boot with an integrated binding strap on the boot upper, using the binding system of the present invention.

In the previously described embodiment, the binding strap 18 has one end secured to the frame 14. In alternative embodiments as shown in FIG. 4, the binding strap 18 can be carried on the boot 10, as an integrated part of the boot 10. In such alternative embodiment, the longer binding strap piece is secured to either the lateral or medial side of the boot, so as to pass over and across the instep portion of the boot. This allows insertion of the foot into the boot. The binding strap on the boot is provided with two fastening buckles 48, one on each end. These buckles 48 engage two corresponding short and separate straps, secured to and projecting upwardly from the frame 14. Alternatively, each end of the binding straps can be serrated, and be inserted into two corresponding buckles on the sides of the frames.

As a further alternative configuration, the previously described embodiment of FIG. 1 can include a single buckle mounted on the frame, rather than the strap, with the strap having a serrated end that is inserted into the buckle for binding.

Figure 7:
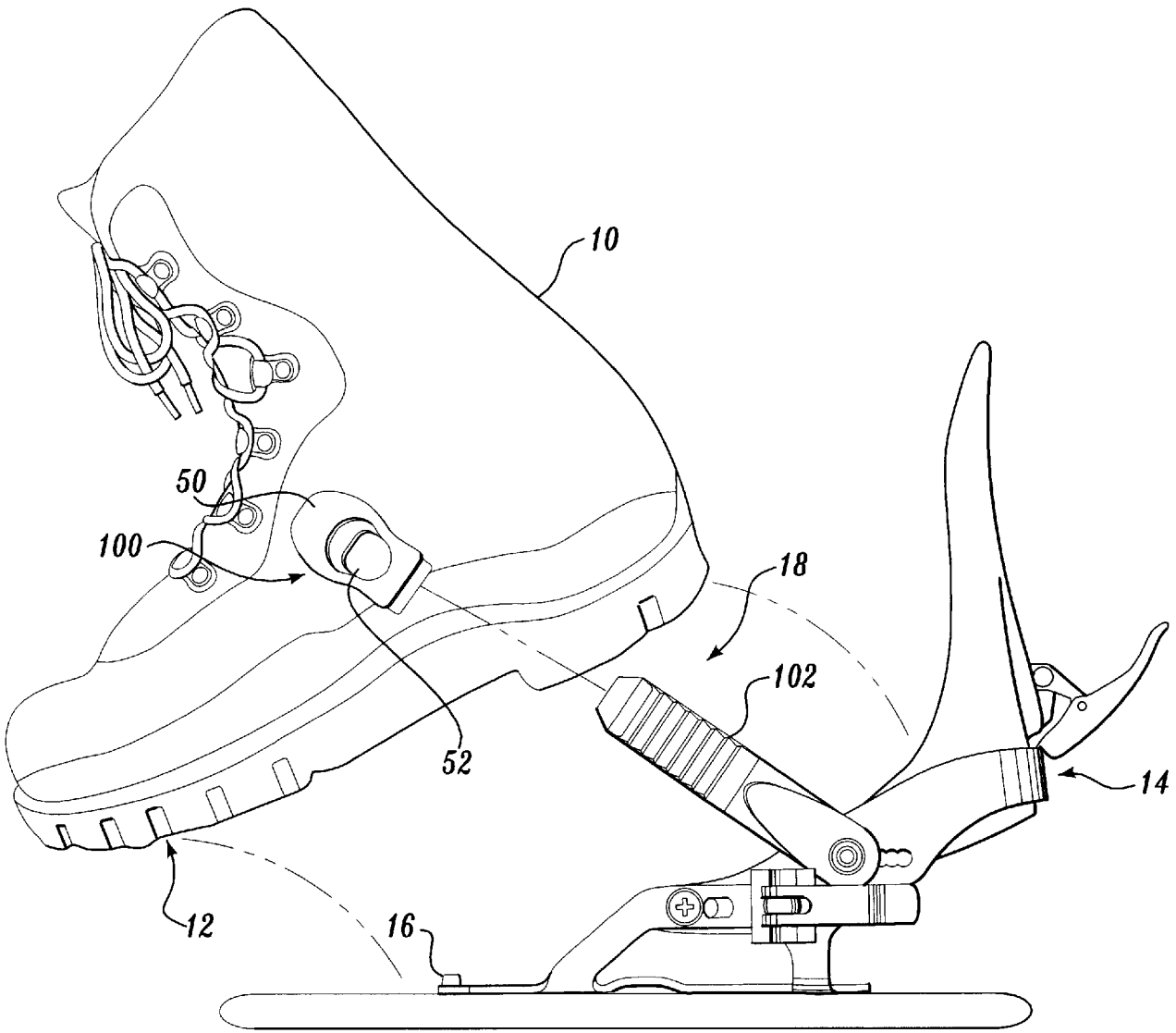
FIG. 7 is a side plan view of one embodiment of the boot with an integrated binding strap buckle on the boot upper, using the binding system of the present invention.

Referring now to FIG. 7, in another embodiment, the binding strap 18 is not restricted to pass over the instep portion of the boot 10. Boot upper is constructed such that boot upper may carry a first 100 and a second (not shown) buckle on the lateral and medial sides of the boot 10, respectively. Each buckle further includes the lever 50, and pawl 52 members of previously described embodiments. Binding strap 18 of FIG. 7 includes a first 102 and a second (not shown) end piece. The first and second end pieces are connected to the lateral and medial side of the frame 14, respectively. The first and the second end pieces engage the first and the second buckles to hold the boot 10 within the frame 14, such that the binding strap 18 does not make a complete pass over the instep portion of the boot 10. This configuration may be applied to a binding strap located at the toe portion of the boot as well, and further still, the end pieces may be attached to the boot while the buckles are on the frame. Still, other alternatives of this embodiment may have a single attachment point to the boot upper, for example, it may include an attachment at the instep portion or the toe portion of the boot with a corresponding attachment at a suitable location on the frame. In this configuration, the single attachment point at the boot upper may be a buckle or a portion of a binding strap. In this embodiment, attachment members 12 and 16 may also be used in combination with a binding strap of any one of a number of configurations.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A binding apparatus for securing a boot having an upper with an instep portion, a forefoot sole portion, and an ankle region to a snowboard comprising:

(a) a frame having a longitudinal axis, said frame having lateral and medial sides defined along either side of the longitudinal axis of the frame, said frame adapted to receive the boot;

(b) a first attachment member provided on the forefoot sole portion of said boot;

(c) a second attachment member provided on said frame for engaging said first attachment member; and (d) an adjustable binding strap connectable to the lateral and medial sides of the frame for securing the boot upper to the frame, the adjustable binding strap extending from the frame to a position forward of the ankle region of the boot, wherein the adjustable binding strap does not pass over the instep portion of the boot.

2. The binding apparatus of claim 1, wherein a portion of the adjustable binding strap is attached to the boot upper.

3. The binding apparatus of claim 2, wherein the portion of the adjustable binding strap attached to the boot upper comprises a first and a second buckle, said first and second buckles connectable to the lateral and medial sides of the frame.

4. The binding apparatus of claim 3, wherein the first and second buckles are attached at opposing sides of the instep of the boot.

5. A binding apparatus for securing a boot having an upper with an instep portion, a forefoot sole portion, and an ankle region to a snowboard comprising:

(a) a frame having a longitudinal axis, said frame including lateral and medial sides disposed along either side of the longitudinal axis of the frame, and a heel support member coupled to the lateral and medial sides and extending rearwardly of the ankle region, said frame adapted to receive the boot;

(b) a first attachment member provided on the forefoot sole portion of said boot;

(c) a second attachment member provided on the frame for engaging said first attachment member; and (d) an adjustable binding strap connectable to the heel support member of the frame for securing the boot upper to the frame, the adjustable binding strap extending from the heel support member at a position proximal of the ankle region of the boot to a position forward of the ankle region of the boot in a generally sloping manner, wherein the adjustable binding strap does not pass over the instep portion of the boot.

* * * * *